US006913807B2

(12) United States Patent
Kamei et al.

(10) Patent No.: US 6,913,807 B2
(45) Date of Patent: Jul. 5, 2005

(54) ISOTHIOCYANATE-CONTAINING COMPOSITION

(75) Inventors: Kiyoshi Kamei, Fukui (JP); Hidenao Saito, Fukui (JP)

(73) Assignee: Rengo Co., Ltd., Osaka (JP)

( * ) Notice: Subject to any disclaimer, the term of this patent is extended or adjusted under 35 U.S.C. 154(b) by 0 days.

(21) Appl. No.: 10/448,108

(22) Filed: May 30, 2003

(65) Prior Publication Data

US 2003/0224131 A1 Dec. 4, 2003

(30) Foreign Application Priority Data

May 31, 2002 (JP) ..... 2002-158545
May 15, 2003 (JP) ..... 2003-136854

(51) Int. Cl.[7] ..... B32B 5/18

(52) U.S. Cl. ..... 428/35.7; 428/423.1; 525/92; 525/95; 525/96

(58) Field of Search ..... 428/35.7, 423.1, 428/413, 419; 525/92, 95, 96

(56) References Cited

U.S. PATENT DOCUMENTS 6,025,067 A * 2/2000 Fay ..... 428/314.4

FOREIGN PATENT DOCUMENTS

JP 2000-343640 12/2000

* cited by examiner

*Primary Examiner*—Sandra M. Nolan
(74) *Attorney, Agent, or Firm*—Wenderoth, Lind & Ponack, L.L.P.

(57) ABSTRACT

An isothiocyanate-containing composition is provided in which bleeding of the composition is suppressed and even if an isothiocyanate volatilizes, the adhesion strength is retained. An isothiocyanate-containing composition is provided wherein an isothiocyanate is mixed into a mixture of a rubber adhesive having a softening point of less than 100° C. and a hydrogenated terpene resin having a softening point of less than 100° C. by an amount of 0.5–15 wt % of an isothiocyanate relative to the total amount of the mixture. The composition has a viscosity at 90° C. of 3000–40000 mPa.s and an adhesion strength of 1 N/25 mm or over when used as an adhesive to laminate two films, irrespective of whether or not the isothiocyanate has volatilized.

8 Claims, No Drawings

ISOTHIOCYANATE-CONTAINING COMPOSITION

BACKGROUND OF THE INVENTION

This invention relates to a composition containing an isothiocyanate, and labels, sheets and packages made of the composition.

Isothiocyanates, which are contained in mustard and wasabi, are known to have antibacterial and antifungus functions. Isothiocyanates reveal their effects even in a small amount. But since they are highly volatile, release control is necessary to sustain their effects.

Japanese patent publication 2000-343640 discloses a method of manufacturing a volatile agent release control film in which an isothiocyanate is dissolved in an adhesive, and the solution obtained is applied to a volatile agent non-permeable film and another volatile agent permeable film is laminated to the applied surface.

But with such a laminated sheet, bleeding of the adhesive may occur from its cut surface. If the selection of a resin forming the film is improper, the adhesion strength tends to decrease as the isothiocyanate volatilizes, so that peeling can occur. Also, if the amount of the isothiocyanate is excessive, the resin may plasticize, so that the adhesion strength may decrease. Further, if the hardness at cut surfaces of the composition in the label or laminated sheet is improper, the composition may bleed from the cut surface or blocking may occur.

An object of this invention is to provide a resin composition in which bleeding of the adhesive is suppressed, and the adhesion strength is retained even after the isothiocyanate has volatilized.

SUMMARY OF THE INVENTION

According to this invention, there is provided an isothiocyanate-containing composition obtained by mixing an isothiocyanate into a mixture of a rubber adhesive having a softening point of less than 100° C. and a hydrogenated terpene resin having a softening point of less than 100° C. by an amount of 0.5 to 15 wt % of the isothiocyanate relative to the total amount of the mixture, the composition having a viscosity at 90° C. of 3000–40000 mPa.s and an adhesion strength of 1 N/25 mm or over when used as an adhesive to laminate a first film to a second film, irrespective of whether or not the isothiocyanate has volatilized.

Since the isothiocyanate-containing composition has a predetermined viscosity, it can be sticked to a film. Because the hardness at cut surface of the composition in the label or the laminated sheet is proper, it is possible to suppress bleeding of the composition from cut surfaces and prevent blocking.

Also, since the predetermined hydrogenated terpene resin is used, it is possible to suppress the vapor pressure of the isothiocyanate. This makes it possible to suppress the volatilizing rate of the isothiocyanate. Also, it is possible to prevent dew condensation due to excessive volatilization of the isothiocyanate.

Also, because a predetermined rubber adhesive is used, a sufficient adhesion strength is assured. Further, by using a hydrogenated terpene resin or a rubber adhesive having a softening point of lower than 100° C., it is possible to suppress the decomposition of the isothiocyanate when the latter is mixed into the mixture.

DETAILED DESCRIPTION OF THE PREFERRED EMBODIMENT

Hereinbelow, the present invention will be described in more detail.

The isothiocyanate-containing composition according to this invention is obtained by mixing an isothiocyanate with a mixture of a rubber adhesive and a hydrogenated terpene resin (hereinbelow referred to "resin mixture").

The rubber adhesive refers to a polymer having rubber elasticity and adhesiveness. As examples thereof, a styrene-butadiene-styrene (hereinafter abbreviated to "SBS") block copolymer, a stylene-isoprene-styrene block copolymer, a styrene-ethylene-butene-styrene block copolymer, a styrene-ethylene-propylene-styrene block copolymer, etc. may be used.

The rubber adhesive should preferably have a softening point of less than 100° C., more preferably less than 80° C. If the softening point is 100° C. or over, the isothiocyanate and the resin mixture have to be kneaded at a higher temperature, so that the possibility of the decomposition of the isothiocyanate increases.

The hydrogenated terpene resin refers to a terpene resin which is hydrogenated and is compatible with a rubber adhesive and solid at room temperature. The hydrogenated terpene resin that has been completely or partially hydrogenated may be used.

The hydrogenated terpene resin has preferably a softening point of less than 100° C., more preferably less than 90° C. If the softening point is 100° C. or over, it is necessary to knead the isothiocyanate and the hydrogenated terpene resin at a higher temperature, so that the possibility of the decomposition of the isothiocyanate increases.

As the isothiocyanate, allyl isothiocyanate, etc. may be used.

The mixing ratio between the rubber adhesive and the hydrogenated terpene resin is preferably 80-20/20-80, more preferably 70-30/30-70 in weight ratio. If the hydrogenated terpene resin is more than 80 wt %, a required adhesion strength may not be obtained. On the other hand, if less than 20 wt %, it is impossible to sufficiently suppress the vapor pressure of the isothiocyanate, thus making it difficult to adjust the volatilizing rate. Also, blocking is liable to occur.

The mixing amount of the isothiocyanate relative to the total amount of the resin mixture of the rubber adhesive and the hydrogenated terpene resin is preferably 0.5–15 wt %, more preferably 0.5–10 wt %. If it is less than 0.5 wt %, antibacterial and antifungus activity may not be obtained. On the other hand, if it is more than 15 wt %, the viscosity of the mixture would decrease, so that bleeding and blocking are liable to occur and a required adhesive strength may not be obtained.

The isothiocyanate-containing composition is obtained first by kneading the rubber adhesive and the hydrogenated terpene resin at a temperature higher than their softening points, adding an isothiocyanate while keeping the temperature, and then kneading.

The viscosity of the isothiocyanate-containing composition at 90° C. is preferably 3000–40000 mPa.s, more preferably 5000–25000 mPa.s. If it is lower than 3000 mPa.s, required adhesion strength may not be obtained. On the other hand, if higher than 40000 mPa.s, coating may be impossible.

When a laminated sheet is manufactured by laminating a first film and a second film using the isothiocyanate-containing composition as an adhesive, the adhesion strength between the films is preferably 1 N/25 mm or over, more preferably 1.5 N/25 mm or over, irrespective of whether or not the isothiocyanate has volatilized. If it is lower than 1 N/25 mm, the film may get delaminated during use.

By coating the isothiocyanate-containing composition according to this invention on a first film, an isothiocyanate-containing labels can be manufactured. Also, by laminating a second film with the above-mentioned coated film, an isothiocyanate-containing laminated sheet can be manufactured.

In this invention, the "laminated sheet" refers to a sheet-like material in which a first film is laminated to a second film by use of the composition as an adhesive.

In manufacturing the isothiocyanate-containing labels, the film and the second film may be made of either an isothiocyanate-permeable material or an isothiocyanate-impermeable material. Also, in manufacturing the isothiocyanate-containing laminated sheets, at least one of the first film and the second film has to be made of an isothiocyanate-permeable material.

As the film made of an isothiocyanate-permeable material, biaxially oriented polypropylene films or cast polypropylene films may be used. As the films made of an isocyanate-impermeable material, polyethylene terephthalate films may be used. A film to which paper or nonwoven fabric is laminated may be used.

The layer of the isothiocyanate containing composition preferably has a thickness of 5–30 μm, more preferably 5–20 μm. If it is thinner than 5 μm, the adhesion strength may be insufficient. On the other hand, if thicker than 30 μm, the isothiocyanate may volatilize from the cut surface, thus increasing loss or causing blocking.

By sticking the isothiocyanate-containing label on the outer surface or inner surface of a package made of an isothiocyanate-permeable film, or sticking it on the inner surface of a package made of an isothiocyanate-impermeable film, it is possible to provide an antibacterial, antifungus package.

In the manufacture of packages made of isothiocyanate-permeable films, the isothiocyanate-containing labels sticked to its outer surface may be made of either isothiocyanate-permeable material or isothiocyanate-impermeable material. But the isothiocyanate containing labels sticked to its inner surface has to be made of an isothiocyanate-permeable material.

On the other hand, in the manufacture of packages made of isothiocyanate-impermeable films, if an isothiocyanate-containing label is sticked to its outer surface, expected effects could not be obtained because the isothiocyanate would not permeate. Therefore, an isothiocyanate-containing label should be sticked to its inner surface and the label should be made of an isothiocyanate-permeable material.

By sticking an isothiocyanate-containing label in such a manner, it is ensured that isothiocyanate will volatilize toward the inside of the antibacterial antifungus package.

By inserting the isothiocyanate-containing laminated sheet in a package, an antibacterial, antifungus packaging bag is provided. If a heat-sealable film is used as the first film and the second film for forming the isothiocyanate-containing laminated sheet, it is possible to simultaneously heat-seal one or both ends of the isothiocyanate-containing laminated sheet when forming a packaging bag by heat-sealing.

A bag can be made from the isothiocyanate-containing laminated sheet. Also, an antibacterial antifungus package in the form of a bag can be obtained by using an isothiocyanate-permeable material inside of the bag.

EXAMPLES

This invention will be described more specifically by referring to Examples and Comparative Examples. First, measurement and evaluation methods will be described.

[Determination of the Remaining Allyl Isothiocyanate (Hereinbelow Abbreviated to "AIT")]

Label or laminated sheet was soaked in dichloromethane, and after shaking for 24 hours, the AIT amount in the extract was analyzed by gas chromatography.

[Viscosity]

Using a Brookfield viscometer made by TOKIMEC INC. (rotor No. 6), the viscosity (in mPa.s) was measured with the resin compositions to be measured kept at 90° C.

[Adhesion Strength Test]

The test was conducted under JIS K6854. The maximum load at that time was taken as the adhesion strength (in N/25 mm). As the film and the second film, polyethylene terephthalate films (hereinbelow PET films) (25 μm thick) were used for both surfaces.

[Evaluation for Blocking]

The laminated sheets obtained were cut to 50 mm×60 mm, and each of them was sandwiched between two 100 mm×100 mm PET films (25 μm thick). Further, each sandwiched sheet was sandwiched between 160 mm×160 mm metallic plates, and with a weight placed thereon to uniformly apply a load of 1 kg, it was let to stand for 24 hours at 40° C. Thereafter, the sandwiched PET films were peeled to check the existence of blockings at ends of the laminated sheet-like articles.

○: No blocking observed at ends of the laminated sheet-like articles.

X: Blocking observed at ends of the laminated sheet-like articles.

Example 1

47.5 parts by weight of an SBS block copolymer having a softening point of 57° C. (made by Nitta Gelatin Inc: HT-480) and 47.5 parts by weight of a hydrogenated terpene resin having a softening point of 85° C. (made by Yasuhara Chemical Co., ltd.: Clearon P-85) were heated to 90° C. to melt, 5.0 parts by weight of AIT was added thereto. The mixture was heated and kneaded for ten minutes to prepare a kneaded molten composition having a melt viscosity of 12500 mPa.s. The kneaded molten composition was coated on a PET film 25 μm thick with a hot melt coater so that the coating will be 10 μm thick. Further, a cast polypropylene film having a thickness of 20 μm was laminated to obtain a three-layered laminated sheet in which an isothiocyanate-containing composition is disposed between two films. The laminated sheet obtained was placed in a 23° C. thermostatic chamber, and the AIT amount in the laminated sheet was determined using gas chromatography with time. Also, by the abovesaid method, it was evaluated for the viscosity, adhesion strength and blocking.

Example 2

Except that 70.0 parts by weight of an SBS block copolymer (made by Nitta Gelatin Inc: HT-480) and 25.0 parts by weight of a hydrogenated terpene resin (made by Yasuhara Chemical Co., Ltd.: Clearon P-85) were used, and that the viscosity at 90° C. after adding AIT was 17500 mPa.s, a three-layered laminated sheet was obtained in the same manner as in Example 1. For the laminated sheet obtained, according to the method described in Example 1, the AIT decrease (%) and the peel strength and blocking were evaluated.

Comparative Example 1

Except that instead of the SBS block copolymer (made by Nitta Gelatin Inc: HT-480), an SIS block copolymer having a softening point of 100° C. (made by Nitta Gelatin Inc: HT-474A) was used, and that the viscosity at 130° C. at which kneading of the resin was possible, was 59000 mPa.s (since kneading of the resin was impossible at 90° C., it was kneaded at 130° C.), a three-layered laminated sheet was obtained in the same manner as in Example 1. For the laminated sheet obtained, according to the method described in Example 1, the AIT decrease (%) and the peel strength and blocking were evaluated.

Comparative Example 2

Except that instead of the hydrogenated terpene resin (made by Yasuhara Chemical Co., Ltd.: Clearon P-85), a rosin ester having a softening point of 86° C. (made by Arakawa Chemical Co., Ltd.: AAG) was used, and that the viscosity at 90° C. after adding AIT was 10500 mPa.s, a three-layered laminated sheet was obtained in the same manner as in Example 1. For the laminated sheet obtained, according to the method described in Example 1, the AIT decrease (%) and the peel strength and blocking were evaluated.

Comparative Example 3

Except that only 95.0 parts by weight of an SBS block copolymer (made by Nitta Gelatin Inc: HT-480) was used and the viscosity at 90° C. after adding AIT was 19000 mPa.s, a three-layered laminated sheet was obtained in the same manner as in Example 1. For the laminated sheet-like article obtained, according to the method described in Example 1, the AIT decrease (%) and the peel strength and blocking were evaluated.

Comparative Example 4

Except that only 95.0 parts by weight of a hydrogenated terpene resin (made by Yasuhara Chemical Co., Ltd.: Clearon P-85) was used and the viscosity at 90° C. after adding AIT was 80000 mPa.s, a three-layered sheet was obtained in the same manner as in Example 1. For the laminated sheet obtained, according to the method described in Example 1, the AIT decrease (%) and the peel strength and blocking were evaluated.

Comparative Example 5

Except that 20.0 parts by weight of AIT was kneaded to a mixture of 40.0 parts by weight of an SBS block copolymer (made by Nitta Gelatin Inc: HT-480) and 40.0 parts by weight of a hydrogenated terpene resin (made by Yasuhara Chemical Co., Ltd.: Clearon P-85), and that the viscosity at 90° C. was 2500 mPa.s, a three-layered laminated sheet was obtained in the same manner as in Example 1. For the laminated sheet obtained, according to the method described in Example 1, the AIT decrease (%) and the peel strength and blocking were evaluated.

TABLE 1

| | | | Adhesion strength | | | AIT remain (mg/100 cm$^2$) | |
|---|---|---|---|---|---|---|---|
| | | Viscosity (mPa · s) | Before AIT volatilize (N/25 mm) | After AIT volatilize (N/25 mm) | Blocking | Before testing | 3 hours after start of testing |
| Example | 1 | 12,500 | 3.3 | 16.4 | ○ | 2.7 | 1.6 |
| | 2 | 17,500 | 2.0 | 16.1 | ○ | 3.0 | 1.6 |
| Comp. Example | 1 | 59,000 | *1 | *1 | *1 | *1 | *1 |
| | 2 | 10,500 | 0.7 | 0.3 | x | 2.6 | 1.9 |
| | 3 | 19,000 | 2.7 | 15.7 | x | 2.9 | 0.8 |
| | 4 | 80,000 | *1 | *1 | *1 | *1 | *1 |
| | 5 | 2,500 | 0.4 | 15.1 | x | 7.8 | 2.6 |

*1: High viscosity made uniform coating impossible. Thus not measured.

(Results)

In Comparative Example 1, since a rubber adhesive having a softening point of 100° C. was used, it was impossible to knead the resin at 90° C. Thus kneading was carried out at 130° C. But the AIT decomposed and odor change occurred.

In Comparative Example 2, instead of a hydrogenated terpene resin, a rosin ester was used. But the adhesion strength was low. Also, blocking occurred.

Further, in Comparative Example 3, since an SBS block copolymer was used alone, the adhesion strength was sufficient, but blocking occurred.

Further, in Comparative Example 4, since a hydrogenated terpene resin was used alone, the viscosity increased, so that coating was impossible.

Also, in Comparative Example 5, due to increase in the content of the AIT, the kneaded resin was plasticized, so that the adhesion strength was insufficient. Thus, blocking occurred.

In contrast, in Examples 1 and 2, it was found that the adhesion strength was high and no blocking occurred, so that sufficient expected effects were obtained.

By coating the isothiocyanate-containing composition according to this invention on a film to form a label or sheet, it is possible to suppress bleeding of the composition from cut surfaces and control the volatilization of the isothiocyanate.

Also, because a predetermined rubber adhesive is used, a sufficient adhesion strength is assured. Further, by using a resin having a softening point of less than 100° C., it is possible to suppress the decomposition of the isothiocyanate used.

Further, because a predetermined rubber adhesive is used, a sufficient adhesion strength is assured.

Also, by using a hydrogenated terpene resin or rubber adhesive having the softening point of lower than 100° C., it is possible to suppress the decomposition of isothiocyanate when the latter is mixed into the mixture of a rubber adhesive and a hydrogenated terpene resin.

What is claimed is:

1. An isothiocyanate-containing composition comprising a mixture of a rubber adhesive having a softening point of less than 100° C., a hydrogenated terpene resin having a softening point of less than 100° C., and an isothiocyanate, the content of said isothiocyanate being 0.5 to 15 wt % relative to the total amount of the mixture, said composition having a viscosity of 3000–40000 mPa.s at 90° C. and an adhesion strength of 1 N/25 mm or over in a laminate, irrespective of whether or not said isothiocyanate has volatilized, said isothiocyanate being reactive with neither said rubber adhesive nor said hydrogenated terpene resin, and being releasable from said composition in a controlled manner, said hydrogenated terpene resin controlling the release of said isothiocyanate.

2. An isothiocyanate-containing label including the isothiocyanate-containing composition claimed in claim 1.

3. An isothiocyanate-containing label as claimed in claim 2 wherein the layer of said isothiocyanate-containing composition has a thickness of 5–30 $\mu$m.

4. An antibacterial, antifungal package wherein the isothiocyanate-containing label claimed in claim 2 or 3 is adhered to the outer or inner surface of a package made of an isothiocyanate-permeable material, or on the inner surface of a package made of an isothiocyanate-impermeable material.

5. An isothiocyanate-containing laminated sheet wherein the isothiocyanate-containing composition claimed in claim 1 is coated on a first film, and a second film is laminated to the coating of the isothiocyanate-containing composition on said first film.

6. An isothiocyanate-containing laminated sheet as claimed in claim 5 wherein said isothiocyanate-containing composition is coated in a thickness of 5–30 $\mu$m.

7. An antibacterial, antifungal packaging bag wherein the isothiocyanate-containing laminated sheet as claimed in claim 5 or 6 is inserted in a packaging bag.

8. An antibacterial, antifungal bag made from an isothiocyanate-containing laminated sheet as claimed in claim 5 or 6 wherein an isothiocyanate-permeable material is used for the inner surface of said bag.

* * * * *